United States Patent [19]

Binstock et al.

[11] Patent Number: 4,471,620

[45] Date of Patent: Sep. 18, 1984

[54] TURBINE LOW PRESSURE BYPASS SPRAY VALVE CONTROL SYSTEM AND METHOD

[75] Inventors: Morton H. Binstock, Pittsburgh, Pa.; Leaman B. Podolsky, Wilmington, Del.; Thomas H. McCloskey, Palo Alto, Calif.

[73] Assignee: Westinghouse Electric Corp., Pittsburgh, Pa.

[21] Appl. No.: 321,160

[22] Filed: Nov. 13, 1981

[51] Int. Cl.[3] ..... F01K 13/02

[52] U.S. Cl. ..... 60/653; 60/661; 60/663; 60/677

[58] Field of Search ..... 60/646, 653, 654, 657, 60/663, 677, 679, 661

[56] References Cited

U.S. PATENT DOCUMENTS 3,774,396 11/1973 Borsi ..... 60/667 UX 4,372,125 2/1983 Dickenson ..... 60/653 X

*Primary Examiner*—Allen M. Ostrager

*Attorney, Agent, or Firm*—D. Schron

[57] ABSTRACT

A bypass system for a steam turbine wherein the energy level of the steam bypassed around the intermediate pressure and low pressure turbines is modified by introduction of cooling water. The amount of water introduced is adaptively varied as a function of the enthalpy of the bypassed steam as measured by a sensor in the steam path.

19 Claims, 5 Drawing Figures

TURBINE LOW PRESSURE BYPASS SPRAY VALVE CONTROL SYSTEM AND METHOD

BACKGROUND OF THE INVENTION

1. Field of the Invention

The invention in general relates to steam turbine bypass systems, and more particularly to a control arrangement for regulating steam energy level in the low pressure portion of the system.

2. Description of the Prior Art

In the operation of a steam turbine power plant, a boiler produces steam which is provided to a high pressure turbine section through a plurality of steam admission valves. Steam exiting the high pressure turbine section is reheated, in a conventional reheater, prior to being supplied to an intermediate pressure turbine section (if included) and thereafter to a low pressure turbine section, the exhaust from which is conducted into a condenser where the exhaust steam is converted to water and supplied to the boiler to complete the cycle.

The regulation of the steam through the high pressure turbine section is governed by the positioning of the steam admission valves and as the steam expands through the turbine sections, work is extracted and utilized by an electrical generator for producing electricity.

A conventional fossil fueled steam generator, or boiler, cannot be shut down instantaneously. If, while the turbine is operating, a load rejection occurs necessitating a turbine trip (shutdown), steam would normally still be produced by the boiler to an extent where the pressure increase would cause operation of various safety valves. In view of the fact that the steam in the system is processed to maintain a steam purity in the range of parts per billion, the discharging of the process steam can represent a significant economic waste.

Another economic consideration in the operation of a steam turbine system is fuel costs. Due to high fuel costs, some turbine systems are purposely shut down during periods of low electrical demands (for example, overnight) and a problem is encounterd upon a hot restart (the following morning) in that the turbine has remained at a relatively hot temperature whereas the steam supplied upon boiler start-up is at a relatively cooler temperature. If this relatively cool steam is admitted to the turbine, the turbine would experience thermal shock which would significantly shorten its useful life. To obviate this thermal shock the steam must be admitted to the turbine very slowly, thereby forcing the turbine to cool down to the steam temperature, after which load may be picked up gradually. This process is not only lengthy, it is also costly.

As a solution to the load rejection and hot restart problems, bypass systems are provided in order to enhance process on-line availability, obtain quick restarts, and minimize turbine thermal cycle expenditures. Very basically, in a bypass operation, the steam admission valves to the turbine may be closed while still allowing steam to be produced by the boiler. A high pressure bypass valve may be opened to divert the steam (or a portion thereof) around the high pressure turbine section, and provide it to the input of the reheater. A low pressure bypass valve allows steam exiting from the reheater to be diverted around the intermediate and low pressure turbine sections and be provided directly to the condenser.

Normally the turbine extracts heat from the steam and converts it to mechanical energy, whereas during a bypass operation, the turbine does not extract the heat from the bypassed steam. Since the elevated temperature of the steam would damage the reheater and condenser, relatively cold water is injected into the high and low pressure bypass steam paths so as to prevent overheating of the reheater and condenser.

With respect to the injection of water into the low pressure bypass steam path, typical prior art arrangements inject a quantity of cooling water which is a certain fixed percentage of the amount of steam in the bypass path. The fixed percentage is based upon maximum enthalpy of the steam, where enthalpy is an indication of heat content in BTU's per pound, so as to reduce it to a value compatible with the condenser. With the same steam flow, however, with a lesser enthalpy, an excess amount of water is injected into the bypass path causing potential problems not only to the condenser but to the low pressure turbine as well.

The present invention provides a significantly improved low pressure bypass fluid injection control system so as to minimize, if not eliminate, condenser and turbine damage.

SUMMARY OF THE INVENTION

An improved system for controlling the steam enthalpy in the low pressure bypass path of a steam turbine system includes means for introducing cooling fluid into the steam path which bypasses the low pressure turbine of the system. Means are provided for obtaining an indication of the enthalpy of the steam which exits the reheater of the system and the introduction of cooling fluid is controlled as a function of the steam enthalpy indication.

Since steam enthalpy is directly related to steam temperature, the indication of enthalpy may be obtained by directly measuring the temperature of the reheater exit steam. A certain percentage multiplication factor is then derived from this measurement. A desired cooling fluid flow control signal is generated by obtaining an indication of steam bypass flow and modifying it by the derived multiplication factor. In this manner, the amount of cooling fluid introduced is a function of steam conditions as opposed to a fixed percentage as in prior art arrangements.

BRIEF DESCRIPTION OF THE DRAWINGS

Similar reference characters refer to similar parts throughout the figures.

DESCRIPTION OF THE PREFERRED EMBODIMENT

Figure 1:
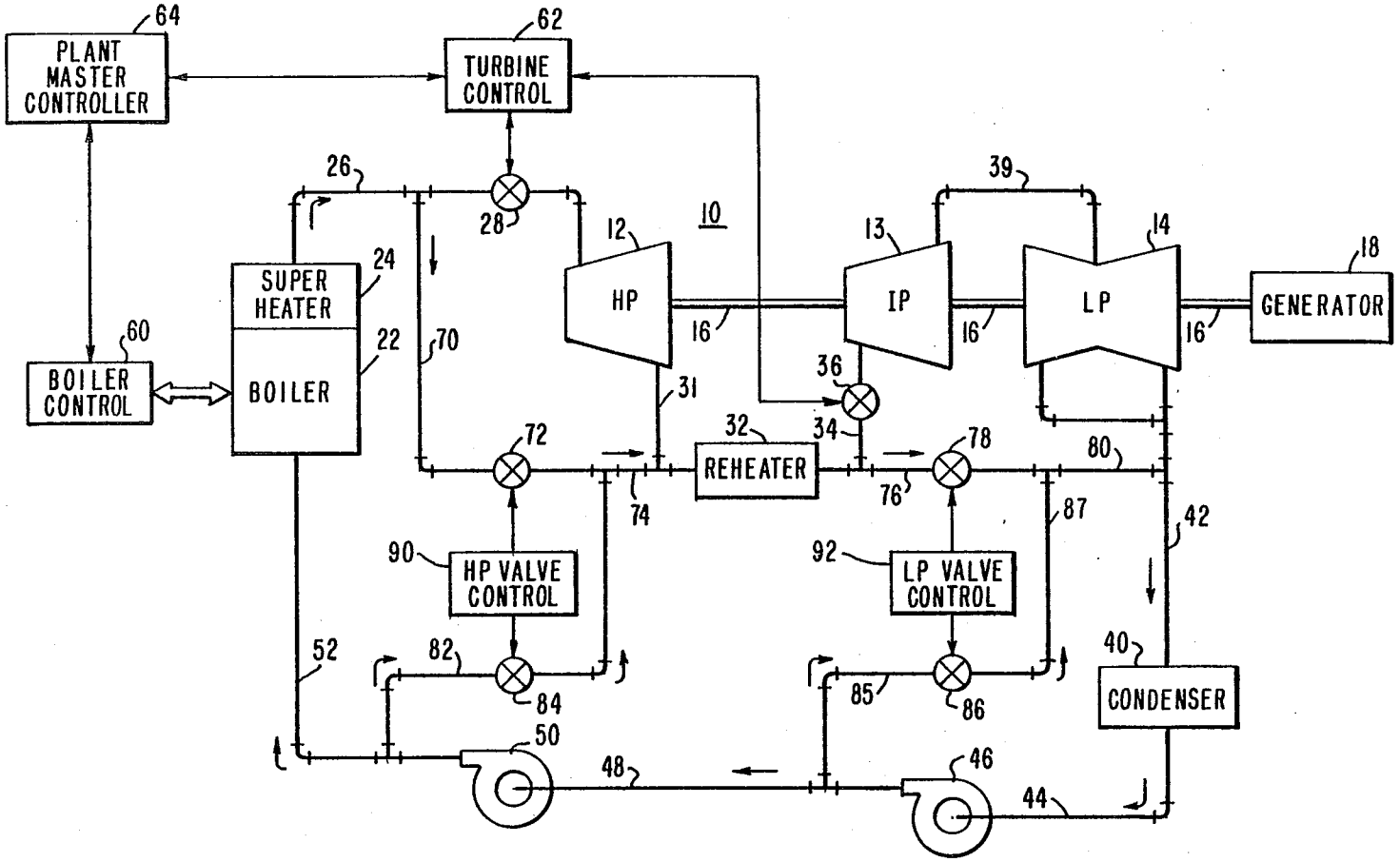
FIG. 1 is a simplified block diagram of a steam turbine generator power plant which includes a bypass system.

FIG. 1 illustrates by way of example a simplified block diagram of a fossil fired single reheat turbine generator unit. In a typical steam turbine generator power plant such as illustrated in FIG. 1, the turbine system 10 includes a plurality of turbine sections in the form of a high pressure (HP) turbine 12, an intermediate pressure (IP) turbine 13 and a low pressure (LP) turbine 14. The turbines are connected to a common shaft 16 to drive an electrical generator 18 which supplies power to a load (not illustrated).

A steam generating system such as a conventional drum-type boiler 22 operated by fossil fuel, generates steam which is heated to proper operating temperatures by superheater 24 and conducted through a throttle header 26 to the high pressure turbine 12, the flow of steam being governed by a set of steam admission valves 28. Although not illustrated, other arrangements may include other types of boilers, such as super and subcritical oncethrough types, by way of example.

Steam exiting the high pressure turbine 12 via steam line 31 is conducted to a reheater 32 (which generally is in heat transfer relationship with boiler 22) and thereafter provided via steam line 34 to the intermediate pressure turbine 13 under control of valving arrangement 36. Thereafter, steam is conducted via steam line 39, to the low pressure turbine 14, the exhaust from which is provided to condenser 40 via steam line 42 and converted to water. The water is provided back to the boiler 22 via the path including water line 44, pump 46, water line 48, pump 50, and water line 52. Although not illustrated, water treatment equipment is generally provided in the return line so as to maintain a precise chemical balance and a high degree of purity of the water.

Operation of the boiler 22 normally is governed by a boiler control unit 60 and the turbine valving arrangements 28 and 36 are governed by a turbine control unit 62 with both the boiler and turbine control units 60 and 62 being in communication with a plant master controller 64.

In order to enhance on-line availability, optimize hot restarts, and prolong the life of the boiler, condenser and turbine system, there is provided a turbine bypass arrangement whereby steam from boiler 22 may continually by produced as through it were being used by the turbines, but in actuality bypassing them. The bypass path includes steam line 70, with initiation of high pressure bypass operation being effected by actuation of high pressure bypass valve 72. Steam passed by this valve is conducted via steam line 74 to the input of reheater 32 and flow of the reheated steam in steam line 76 is governed by a low pressure bypass valve 78 which passes the steam to steam line 42 via steam line 80.

Figure 2:
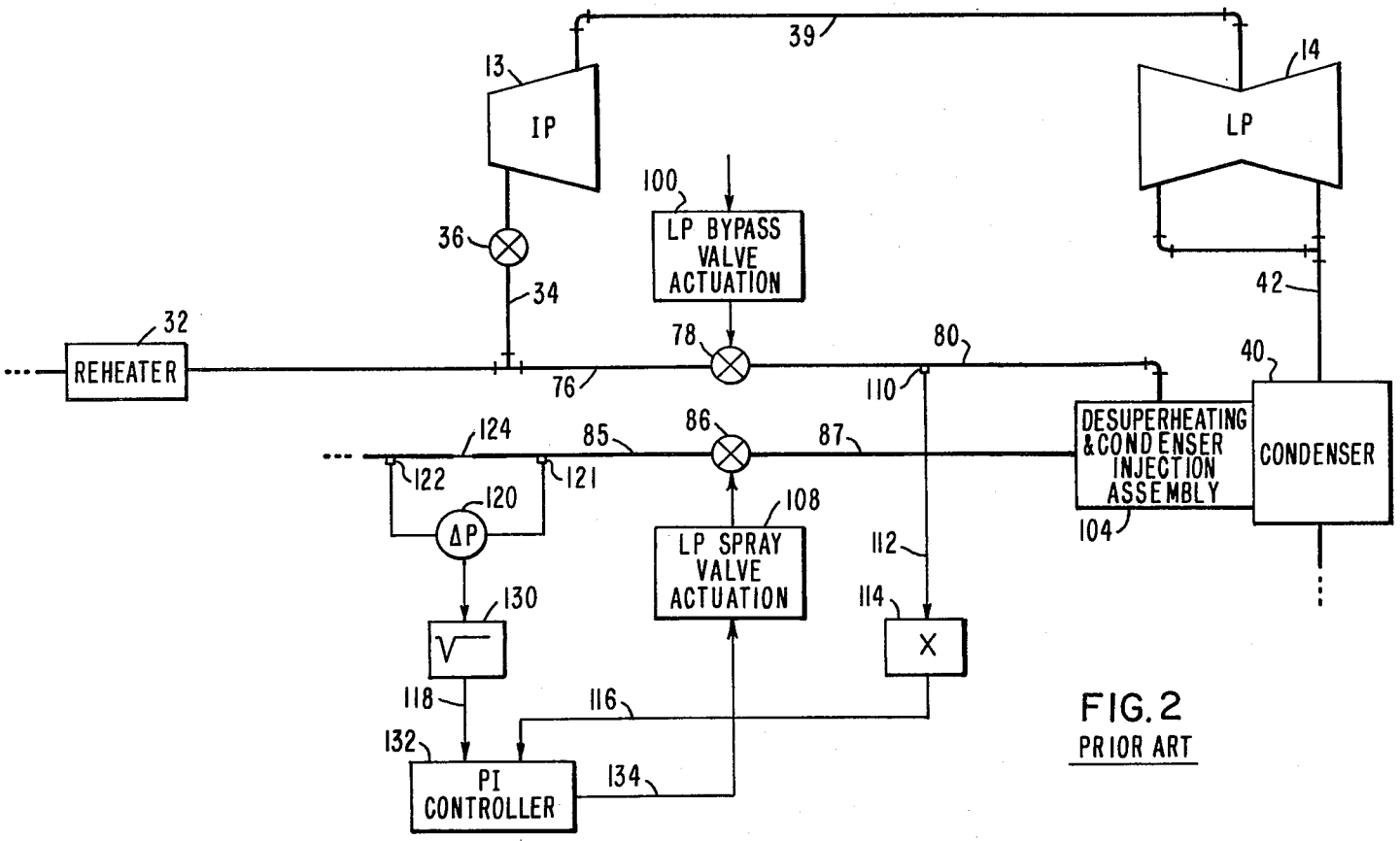
FIG. 2 PRIOR ART
FIG. 2 illustrates a portion of FIG. 1 in more detail to illustrate a typical prior art low pressure bypass water injection control arrangement.

In order to compensate for the loss of heat extraction normally provided by the high pressure turbine 12 and to prevent overheating of the reheater 32, relatively cool water in water line 82, provided by pump 50, is provided to steam line 74 under control of high pressure spray valve 84. Other arrangements may include the introduction of the cooling fluid directly into the valve structure itself. In a similar fashion, relatively cool water in water line 85 from pump 46 is utilized, to cool the steam in steam line 80 to compensate for the loss of heat extraction normally provided by the intermediate pressure and low pressure turbines 13 and 14 and to prevent overheating of condenser 40. A low pressure spray valve 86 is provided to control the flow of this spray water, via water line 87, and control means are provided for governing operation of all of the valves of the bypass system. More particularly, a high pressure valve control 90 is provided and includes a first circuit arrangement for governing operation of high pressure bypass valve 72 and a second circuit arrangement for governing operation of high pressure spray valve 84. Similarly, a low pressure valve control 92 is provided for governing operation of low pressure bypass valve 78 and low pressure spray valve 86. An improved high pressure bypass spray valve control system is described and claimed in copending application Ser. No. 305,814 filed Sept. 25, 1981 and assigned to the same assignee as the present invention. The present invention is concerned with an improved control of the low pressure bypass spray valve, and for comparison purposes a typical prior art low pressure bypass spray valve control is illustrated in FIG. 2.

The low pressure bypass valve actuation circuit 100 is responsive to an input signal from a low pressure bypass control circuit (not illustrated) to open low pressure bypass valve 78 so as to allow the steam emerging from reheater 32 to be provided to condenser 40 thus bypassing intermediate pressure and low pressure turbines 13 and 14.

FIG. 1 schematically illustrated the steam line 80 as connected to line 42 for providing bypass steam to condenser 40. In actuality, many systems include a low pressure desuperheating and condenser injection assembly 104 for cooling the bypass steam and introducing it into the condenser. The cooling fluid (normally water) in line 85 is introduced as a result of the opening of low pressure spray valve 86 under control of valve actuation circuit 108 and cooling water passed by valve 86 is introduced into the desuperheating and condenser injection assembly 104.

The cooling water reduces the bypass steam heat and energy level to a value that is compatible with, and can be absorbed by, the condenser. In the prior art arrangement, the cooling water flow, as governed by the opening of spray valve 86, is a fixed percentage of the bypass steam flow. An indication of bypass steam flow is obtained with the provision of a pressure transducer 110 which provides, on line 112, an output signal which is indicative of steam flow. Multiplier circuit 114 multiplies this value by some fixed percentage, for example, 30%, to provide a desired flow setpoint signal on line 116. That is, valve 86 is to be opened such that the flow of cooling water in line 85 is to be 30% of the steam flow passed by valve 78 and the desired 30% value is the signal appearing on line 116. This signal is compared with another signal on line 118 indicative of the actual flow of cooling water in line 85. The actual flow signal is obtained by the use of a differential pressure transducer 120 having input pressure connections 121 and 122 positioned on either side of restriction 124, with the differential pressure circuit 120 being operable to provide an output signal which is proportional to the square of the flow. Accordingly, square root circuit 130 is provided so as to obtain a signal indicative of the actual flow.

The actual flow signal on line 118 is compared with the desired flow signal on line 116 in proportional plus integral (PI) controller 132. Basically, the PI controller 132 receives the two input signals, takes the difference between them, applies some gain to the difference to derive a signal which is added to the integral of the signal, resulting in a control signal on output line 134. Such PI controllers find extensive use in the control filed and one operative embodiment is a commercially available item from Westinghouse Electric Corporation under their designation 7300 Series Type NCB Controller, Style G06. The PI function may also be implemented, if desired, by a microprocessor or other type of computer.

Thus, in operation, if the two signals on lines 116 and 118 are equal, controller 132 maintains an output signal on line 134 at a value such that spray valve 86 maintains a cooling water flow equal to 30% of steam flow in steam line 80. If either flow should change, the output control signal on line 134 will change so as to further open or close spray valve 86 so as to bring the two valves back to an equilibrium condition.

The fixed percentage value (water flow=30%×steam flow) is based upon maximum heat and energy levels acceptable by the condenser. The cooling water supply reduces the enthalpy of the bypass steam, however, if the enthalpy of the bypass steam decreases while maintaining the same flow, then in actuality, too much water is being supplied for cooling purposes. Over a period of time, excess water can lead to erosion of certain tubes within the condenser as well as cause water hammer resulting in excessive noise and vibration damage. Alternatively, if not enough cooling water is supplied, the steam will be too hot resulting in condenser overheating and with condensers physically located below the low pressure turbine 14, damage may occur to the turbine blading.

In addition, and as illustrated in FIG. 1, the cooling water is supplied by a pump 46. If the amount of cooling water supplied can be reduced while still maintaining adequate condenser protection, then a savings in pump energy consumption may be realized.

Figure 3:
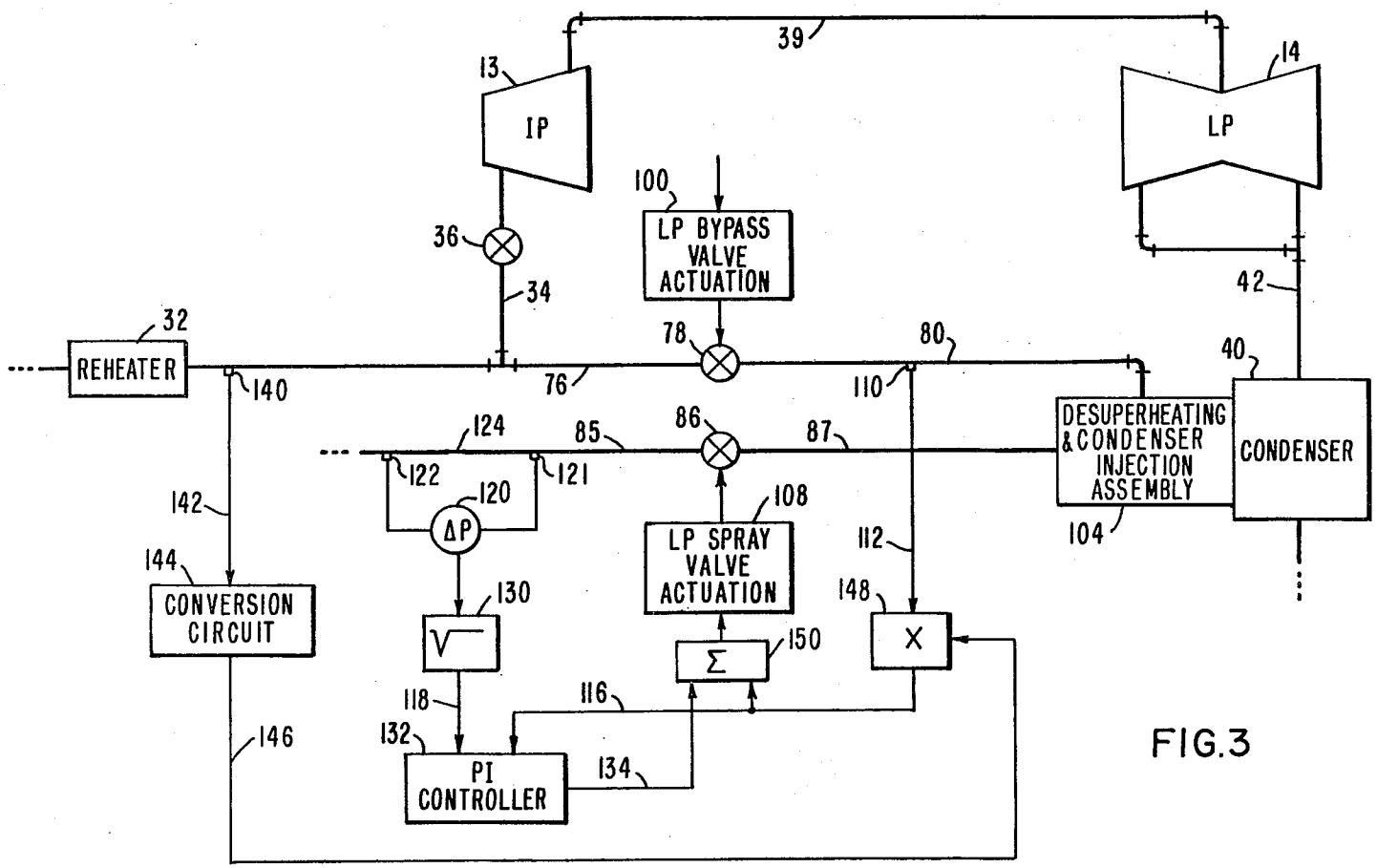
FIG. 3 is a block diagram illustrating an embodiment of the present invention.

The present invention supplies cooling water at a rate which is adaptive to steam conditions for condenser and turbine protection as well as energy savings and reduced pumping requirements. One embodiment is illustrated in FIG. 3 to which reference is now made.

In order to be adaptive to steam conditions, the present invention includes means for obtaining an indication of the energy level, that is, enthalpy, of the bypass steam. The enthalpy of the steam is a function of steam temperture and accordingly a temperature transducer 140 is located at the output of reheater 32 so as to provide, on line 142, an indication of steam enthalpy. This indication may then be utilized to modify the cooling water to steam flow relation, previously set at 30%.

A conversion circuit 144 receives the enthalpy indicative signal on line 142 and provides a modifying signal on line 146. In one embodiment, the modifying signal may be a multiplication factor which varies in value in accordance with the steam enthalpy and which is supplied to multiplier circuit 148. This latter circuit multiplies the steam flow indicative signal on line 112 by the multiplication factor on line 146 to derive the desired flow setpoint signal on line 116.

If desired, the output signal from multiplier circuit 148 may be utilized to initially open spray valve 86 to a position as dictated by the value of the signal on line 116. This is accomplished with the provision of summation circuit 150 which receives the output signal from multiplier circuit 148 as well as the output signal from controller 132. If spray valve 86 is initially opened to the correct position such that the signals on lines 116 and 118 are equal, then controller 132 does not change its output and spray valve 86 remains where it was initially set. If the flow or enthalpy conditions change, then an unbalance in the input signals to controller 132 will result in an output control signal to modify the spray valve opening.

Figure 4:
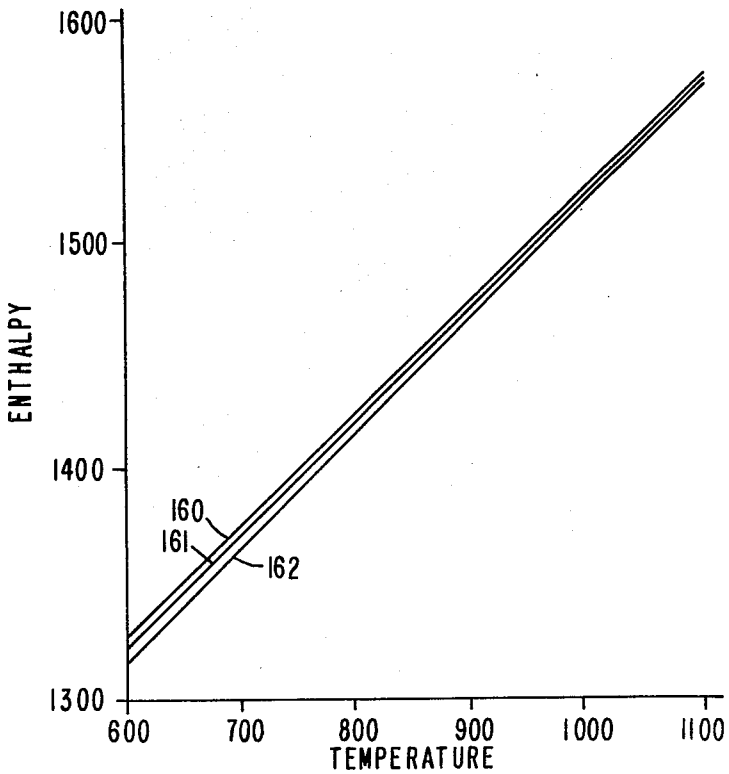
FIG. 4 is a curve illustrating the relationship between steam temperature and enthalpy.

The enthalpy of the steam exiting reheater 32 is related to the steam temperature and over a typical operating range, the relationship is substantially linear. This linear relationship is illustrated by curve 160 of FIG. 4 wherein temperature from 600° F. to 1100° F. is plotted on the horizontal axis and steam enthalpy in BTU's per pound is plotted on the vertical axis. Curve 160 is plotted for a hot reheat pressure (the pressure at the output of reheater 32) of 300 pounds per square inch (psi).

For comparison purposes, the temperature-enthalpy relationship is plotted for hot reheat pressures of 200 psi (curve 161) and 100 psi (curve 162). Assuming a linear relationship over a typical range of operation, the conversion circuit 144 of FIG. 3 therefore may simply be a linear amplifier which receives the enthalpy signal on line 142 and provides an output signal directly proportional to it. Another type of conversion circuit which may be utilized is illustrated in FIG. 5.

Figure 5:
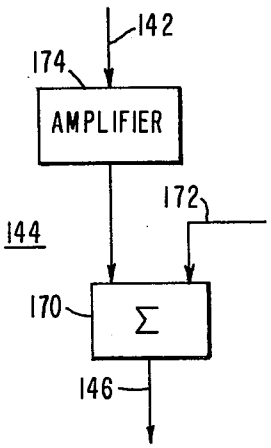
FIG. 5 is a block diagram detailing a portion of the control arrangement of FIG. 3.

In FIG. 5, a summation circuit 170 receives some base signal on line 172 indicative of either a maximum or minimum multiplication factor by which the steam flow indicative signal (on line 112 in FIG. 3) is to be multiplied. If the signal on line 172 is the maximum multiplication factor, then amplifier 174 is responsive to the enthalpy indicative signal on line 142 to provide a proportional output signal which is subtracted from the signal on line 172. For example, if steam conditions are such that maximum cooling water is to be provided, then the output signal from amplifier 174 will be zero such that summation circuit 170 provides the maximum correction factor. If the steam temperature reduces, the output of amplifier 174 increases with the value being subtracted from the maximum value applied on line 172. Conversely, if a minimum multiplication value is applied to line 172, then amplifier 174 and summation circuit 170 would be constructed and arranged such that the amplifier's output signal would increase with increasing enthalpy and would add to the minimum value applied to line 172. Various other modification arrangements are possible and by way of example include the use of a multiplier circuit which initially multiplies the steam flow signal by the 30% factor (or other constant factor) as in the prior art and then subsequently modifies the value so obtained by a modification factor provided by converstion circuit 144.

For those operating ranges where the temperature-enthalpy relationship may not be linear, the conversion circuit 144 may be any one of a number of circuits which provide an output signal which is some predetermined function of its output signal. One such circuit which will perform this operation is a commercially available item from Westinghouse Electric Corporation under their designation 7300 Series Type NCH function generator. Alternatively, the conversion circuit 144 may be digital in nature and include a look-up table into which is programmed the temperature-enthalpy relationship derived from standard steam tables.

The determination of correction factor may be made with reference to the following energy balance equation:

$$W_s h_s + W_w h_w = (W_s + W_w) hc \quad (1)$$

where "W" is flow in pounds per hour, "h" is enthalpy in BTU's per pound. Subscript "s" is associated with the steam, subscript "w" is associated with the water, and subscript "c" is associated with the condenser.

Equation 1 basically states that the flow rate of steam times its enthalpy plus the flow rate of the cooling water times its enthalpy prior to the mixture is equal to the combined flow rate of steam and water times the enthalpy of the resultant fluid entering the condenser. The present arrangement is such so as to maintain the enthalpy of the fluid entering the condenser at a substantially constant value $h_c$.

From equation 1, it may be seen that the proportion of water to steam is $$(W_w/W_s)=((h_s-h_c)/(h_c-h_w)) \quad (2)$$

In equation 2, the steam enthalpy $h_s$ varies over a relatively wide range as a function of temperature and the particular enthalpy for a particular temperature may be obtained from the standard steam tables. The value of $h_c$ which the condenser can accommodate is known and is a function of condenser design. With respect to the enthalpy of the cooling water, over a typical general temperature range, the water enthalpy is relatively insignificant compared with the steam enthalpy and to a fair approximation can be considered to be a constant value. Accordingly, the multiplication factor (which is equivalent to the left-hand side of equation (2) is related to the steam enthalpy which in turn is a function of the steam temperature. In the present arrangement, this steam temperature is measured so as to result in a multiplication factor particularly adapted to the steam conditions so that an excess amount of cooling water is not introduced into the condenser. By way of example, for an $h_c$ of 1190 BTU's per pound, if the maximum hot reheat temperature at 300 psi is 1000°, the multiplication factor is approximately 30% of the steam flow. For example, if on an instantaneous basis, the steam flow was one million pounds per hour, the water flow would be 300,000 pounds per hour. If the minimum operating temperature is 600°, then the multiplication factor is approximately 11%, resulting in a water flow of 110,000 pounds per hour as opposed to the prior art flow of 300,000 pounds per hour and which flow would be constant over the entire temperature range.

Although not illustrated, the modification of the steam flow signal may include a pressure compensation since steam enthalpy also varies with steam pressure. The change in enthalpy over the pressure range (see FIG. 4) however is relatively small and may not justify the added expense.

Accordingly, by having an adaptive multiplication factor directly related to the steam enthalpy, a significant savings in pumping energy may be realized over the operating life of the equipment. More importantly, it ensures that condenser overheating is prevented and ensures that an excessive amount of cooling water is not introduced into the condenser, thus prolonging not only the life of the condenser, but the low pressure turbine as well.

We claim:

1. In a steam turbine system including at least a low pressure turbine and a low pressure steam bypass path for bypassing said turbine, the improvement comprising:

(A) low pressure bypass valve means in said bypass path for controlling the flow of steam therein;

(B) fluid control valve means for introducing cooling fluid into said bypass path;

(C) means for obtaining an indication of the enthalpy of the steam which enters said bypass path;

(D) means for controlling said introduction of said cooling fluid as a function of said enthalpy indication.

2. Apparatus according to claim 1 wherein said means for obtaining includes:

(A) temperature sensor means positioned to sense the temperature of the steam in said bypass path and provide a temperature signal indicative thereof, said temperature of said steam being related to said enthalpy of said steam.

3. Apparatus according to claim 2 wherein:

(A) said temperature sensor is in the path of said steam.

4. Apparatus according to claim 3 wherein:

(a) said temperature sensor is positioned upstream of said bypass valve means.

5. In a steam turbine system including at least a low pressure turbine and a low pressure steam bypass path for bypassing said turbine, the improvement comprising:

(A) low pressure bypass valve means in said bypass path for controlling the flow of steam therein;

(B) fluid control valve means for introducing cooling fluid into said bypass path;

(C) means for obtaining an indication of the enthalpy of the steam which enters said bypass path;

(D) means for deriving and providing a steam flow signal indicative of steam flow in said bypass path;

(E) means for modifying said steam flow signal as a function of said enthalpy indication;

(F) means for controlling the degree of opening of said fluid control valve means in response to said modified steam flow signal.

6. Apparatus according to claim 5 wherein said means for obtaining includes:

(A) temperature sensor means positioned to sense the temperature of the steam in said bypass path and provide a temperature signal indicative thereof, said temperature of said steam being related to said enthalpy of said steam.

7. Apparatus according to claim 6 which includes:

(A) conversion means responsive to said temperature signal and operative to derive a multiplication factor as a function thereof; and wherein (B) said means for modifying applies said multiplication factor to said steam flow signal to derive a desired flow signal.

8. Apparatus according to claim 7 which includes:

(A) means for deriving and providing an actual fluid flow signal indicative of cooling fluid flow; and wherein said means for controlling includes:

(B) a controller responsive to said actual flow signal and said desired flow signal to generate a control signal to control said degree of opening.

9. Apparatus according to claim 8 wherein:

(A) said controller is a proportional plus integral controller.

10. Apparatus according to claim 7 wherein:

(A) said means for modifying is a multiplication circuit which multiplies said steam flow signal by said multiplication factor to derive said desired flow signal.

11. Apparatus according to claim 7 wherein:

(A) if said desired and actual flow signals are equal, said control signal does not vary; and which includes, (B) means for summing said control signal and said desired flow signal to generate a signal for controlling said degree of opening.

12. Apparatus according to claim 7 wherein said conversion means includes:

(A) amplifier means operative to receive and amplify said temperature signal;

(B) means for modifying said amplified signal by a predetermined constant amount.

13. Apparatus according to claim 12 wherein:

(A) said predetermined constant amount is representative of a minimum multiplication factor.

14. Apparatus according to claim 12 wherein:

(A) said predetermined constant amount is representative of a maximum multiplication factor.

15. Apparatus according to claim 6 wherein said steam turbine system includes a reheater in the steam flow path and wherein:

(A) said temperature sensor means is positioned to sense the output temperature of said reheater.

16. In a steam turbine system including at least a low pressure turbine and a low pressure steam bypass path for bypassing said turbine, said bypassed steam being discharged into a condenser, the method of controlling the fluid entering said condenser comprising the steps of:

(A) introducing cooling fluid into said bypass path; and (B) controlling the introducton of said cooling fluid so as to maintain the enthalpy of the fluid entering said condenser at a substantially constant value, over the operating temperature range of said bypassed steam.

17. In a steam turbine sytem including at least a low pressure turbine and a low pressure steam bypass path for bypassing said turbine, said bypassed steam being discharged into a condenser, the method of controlling the fluid entering said condenser comprising the steps of:

(A) obtaining an indication of the enthalpy of the steam which enters said bypass path; and (B) introducing cooling fluid into said bypass path as a function of said enthalpy indication.

18. A method according to claim 17 which includes the step of:

(A) measuring the temperature of the steam entering said bypass path to obtain said enthalpy indication.

19. Apparatus according to claim 17 which includes the steps of:

(A) obtaining a bypass steam flow indication;

(B) obtaining a cooling fluid low indication;

(C) modifying said steam flow indication as a function of said enthalpy indication; and (D) comparing said cooling fluid flow indication with said modified steam flow indication to control said introduction of said cooling fluid.

* * * * *